US008128018B2

(12) United States Patent
Shek

(10) Patent No.: US 8,128,018 B2
(45) Date of Patent: Mar. 6, 2012

(54) AUTOMATIC SENSING AND OUTPUTTING DEVICE

(76) Inventor: Michael Shek, San Mateo, CA (US)

( * ) Notice: Subject to any disclaimer, the term of this patent is extended or adjusted under 35 U.S.C. 154(b) by 324 days.

(21) Appl. No.: 12/562,104

(22) Filed: Sep. 17, 2009

(65) Prior Publication Data

US 2011/0062277 A1 Mar. 17, 2011

(51) Int. Cl.
*B65H 75/18* (2006.01)
*B65H 16/10* (2006.01)

(52) U.S. Cl. ..... 242/597.7; 242/564.4; 242/597.8

(58) Field of Classification Search ..... 242/564, 242/564.1, 564.3, 564.4, 563, 563.1, 566, 242/597.7, 597.8

See application file for complete search history.

(56) References Cited

U.S. PATENT DOCUMENTS

| | | | | |
|---|---|---|---|---|
| 4,569,467 | A * | 2/1986 | Kaminstein | 242/563 |
| 7,178,317 | B1 * | 2/2007 | Koskela | 242/597.8 |
| 7,533,515 | B1 * | 5/2009 | Koskela | 242/597.8 |
| 7,748,585 | B2 * | 7/2010 | Shek | 242/564.1 |
| 2008/0164368 | A1 * | 7/2008 | Shek | 242/564.1 |

* cited by examiner

*Primary Examiner* — William A Rivera

(57) ABSTRACT

The automatic sensing and outputting device of the present invention includes a base, a shell, a cover and a roller unit. The base has a longitudinal rod extending from an upper side thereof which the shell parallels. The cover pivoted at one ends on the shell and is swayable. The roller unit is rotatably disposed in the shell and is driven by a rotating means. Thereby, the cover and the roller unit are adapted to clamp a sheet-like object therebetween and to output the sheet-like object when the roller unit rotates.

13 Claims, 8 Drawing Sheets

AUTOMATIC SENSING AND OUTPUTTING DEVICE

BACKGROUND OF THE INVENTION

1. Field of the Invention

The present invention relates to an automatic sensing and outputting device that outputs a sheet-like object with a predetermined length while one approaches.

2. Description of the Prior Art

A reel of paper is placed in a present roller-type paper outputting device, and a cutter is disposed at a paper output portion of the device. The reel of paper is outputted for a length and then cut by the cutter. Some conventional outputting device has been provided with a motor to drive a reel to rotate to deliver the paper while a sensor of the device senses a user approaches.

As disclosed in the applicant's prior proposed patent (TWM312970 or its corresponding U.S. application Ser. No. 11/649,771), a conventional sensing and outputting device includes a reel (31) and a press plate (33) to clamp an end of a paper towel or the like. The reel (31) can be driven by a motor (13) to rotate, outputting the paper towel for a predetermined length. The press plate (33) is pushed by an elastic member (34) to abut against the reel (31). When one wants to replace the paper towel, one has to remove a positioning cover (12) first and then press an actuating lever (332) to disengage the press plate (33) from the reel (31), which leads to inconvenience.

SUMMARY OF THE INVENTION

The main object of the present invention is to provide a sensing and outputting device that is convenient to replace a sheet-like object.

To achieve the above object, an automatic sensing and outputting device is provided with a base, a shell, a cover and a roller unit. The base has a longitudinal rod extending from an upper side thereof which the shell parallels. The cover pivoted at one ends on the shell and is swayable. The roller unit is rotatably disposed in the shell and is driven by a rotating means. Thereby, the cover and the roller unit are adapted to clamp a sheet-like object therebetween and to output the sheet-like object when the roller unit rotates.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
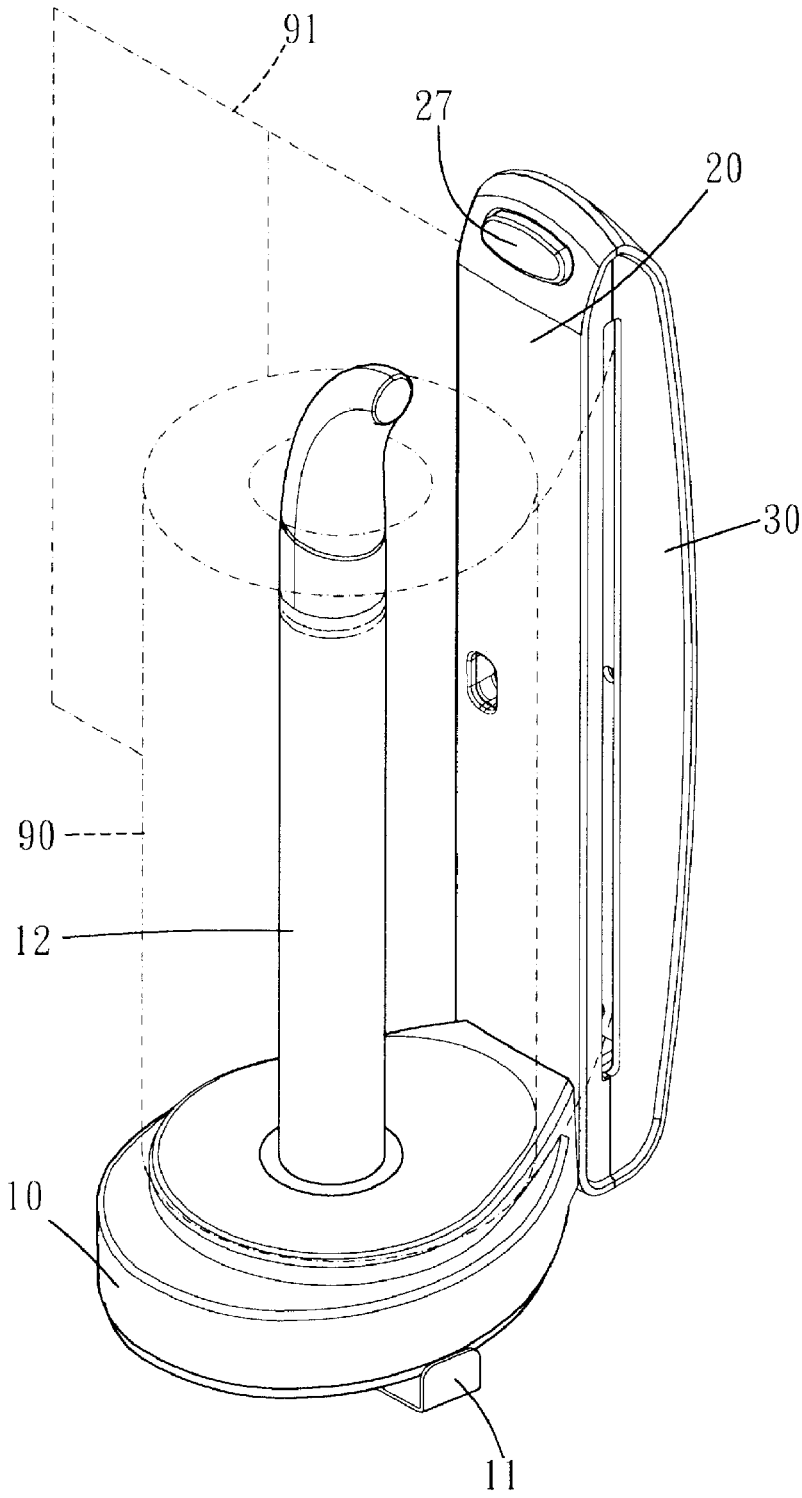
FIG. 1 is a drawing showing a sensing and outputting device in accordance with a preferred embodiment of the present invention.

Please refer to FIG. 1 for an automatic sensing and outputting device in accordance with a preferred embodiment of the present invention. The device includes a base 10, a shell 20, a cover 30, a roller unit 40, a rotating means 50 to rotate the roller unit 40, and a control unit 60. The device of the present invention is adapted to sense one approaching and then to output a sheet-like object, such as toilet paper, paper towel, tin foil or the like, for a predetermined length automatically.

Figure 2:
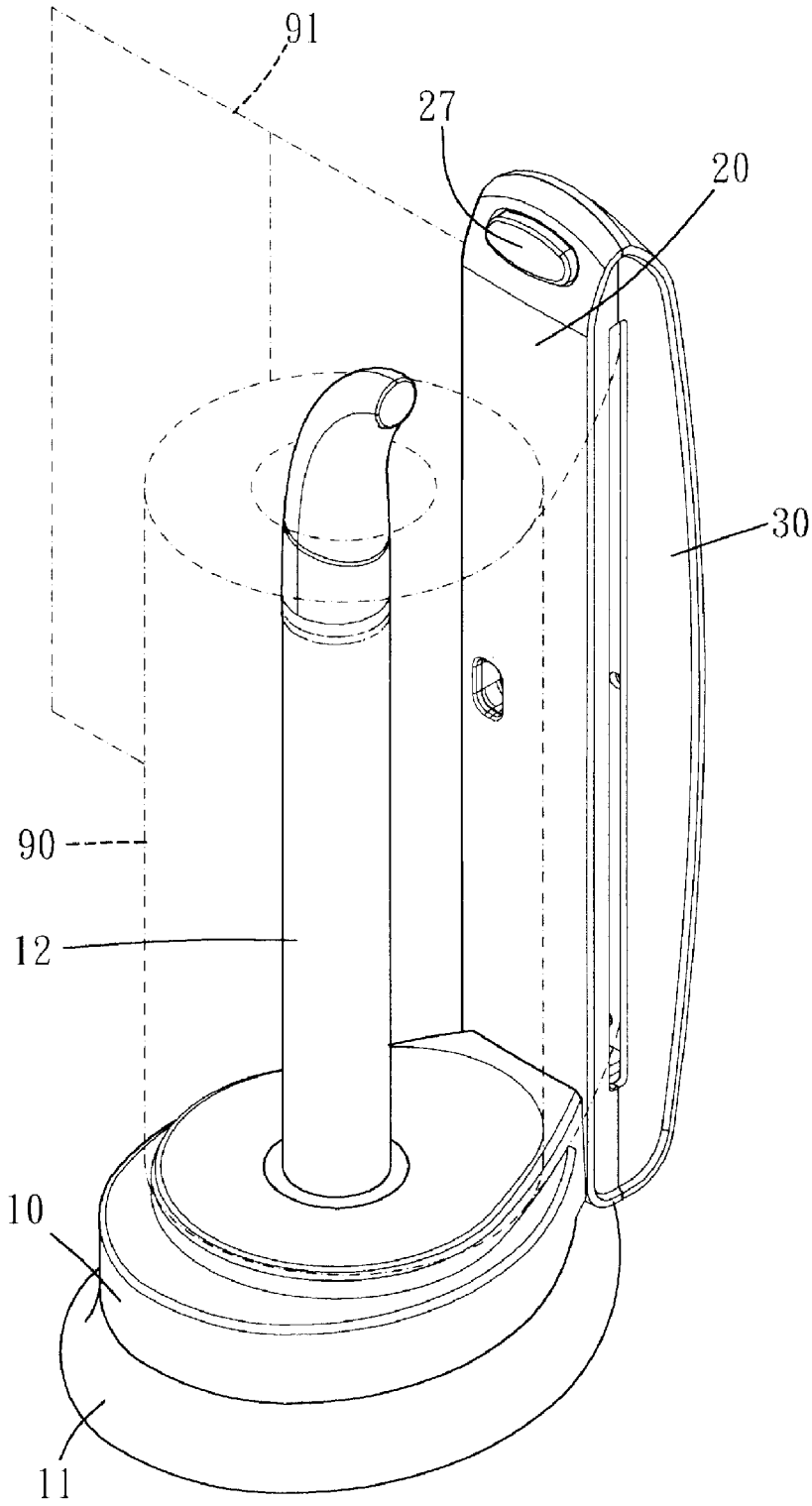
FIG. 2 is a drawing showing a sensing and outputting device along with a positioning plate in accordance with a preferred embodiment of the present invention.

The base 10 has a bottom side on which a positioning plate 11 is disposed. The positioning plate 11 may be a locking element as shown in FIG. 1 so that the device can be installed on a wall or anywhere suitable. The positioning plate 11 may have a lager circumference that can be placed on a table as shown in FIG. 2, and an anti-slip element (unshown), such as a sucker or an anti-slip pad, may be additionally disposed under the positioning plate 11. The base 10 has a longitudinal rod 12 extending from an upper side thereof, and a distal end of the rod 12 is tapered and laterally bent so that the distal end is laterally protrusive from the other part of the rod 12. As such, one can place a reel of sheet-like object 90 on the rod 12 from the bent distal end obliquely, and the reel of sheet-like object 90 will not inadvertently slide out from the rod 12 and will only be pulled out as it is held obliquely to escape the bent distal end. That is to say, the positioning cover of the conventional device is no longer needed to hold the sheet-like object in the present embodiment.

The shell 20 is disposed on the base 10 and parallel to an orientation of the longitudinal rod 12. The shell 20 consists of a first shell body 21 and a second shell body 22 that is assemblable with the first shell body 21 to define a receiving space therebetween. The second shell body 22 has an opening 23 disposed in a direction parallel to its length, and the opening 23 communicates with the receiving space. In addition, at least one anti-convolving unit 24 can be laterally disposed on the second shell body 22 to divide the opening 23 into several windows 25, prohibiting the start end 91 of the sheet-like object 90 from being inadvertently entrapped in the receiving space. For instance, there are four anti-convolving unit 24 presented in this embodiment and the opening 23 is divided into five windows 25.

The cover 30 is pivoted at one of its ends, either its bottom end or its upper end, on the shell 20 so as to be swayable between a first position and a second position. In the present embodiment, the bottom end of the cover 30 is pivoted on the shell 20. As such, the cover 30 can sway spontaneously to the second position by gravity while released from the first position. The cover 30 consists of a first cover body 31 and a second cover body 32 assemblable with the first cover body 31 to receive other parts therein. When the cover 30 locates at the first position, it substantially envelopes the opening. In addition, the cover 30 has an arc surface facing the opening.

To hold the cover 30 at the first position, an engaging protrusion 33 and an engaging slot 26 are provided between the shell 20 and the cover 30. In the present invention, the engaging protrusion 33 is disposed on the cover 30 where faces the shell 20, and the engaging slot 26 is disposed on the shell 20 where faces the cover 30 and corresponds to the engaging protrusion 33. As such, the engaging protrusion 33 engages with the engaging slot 26 as the cover 30 locates at the first position to hold the cover 30 steadily. It is to be noted that the engaging protrusion 33 may be disposed on the shell 20 instead, and the engaging slot 26 may, therefore, be disposed on the cover 30. Furthermore, a button 27 is disposed near the engaging slot 26 to be pushed by one to release the engaging protrusion 33 from the engaging slot 26.

Figure 4:
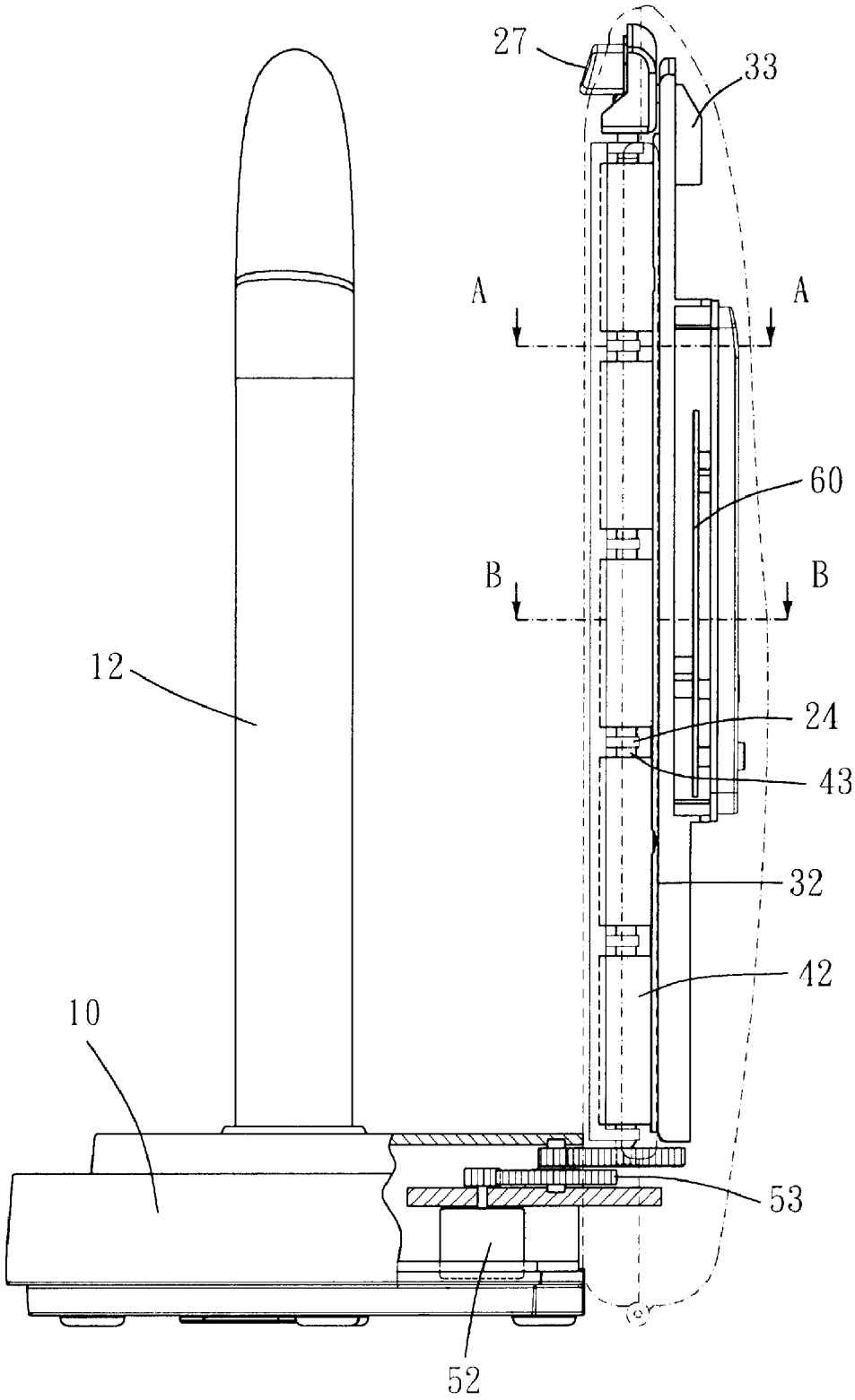
FIG. 4 is a partial profile of a sensing and outputting device in accordance with a preferred embodiment of the present invention.
Figure 5:
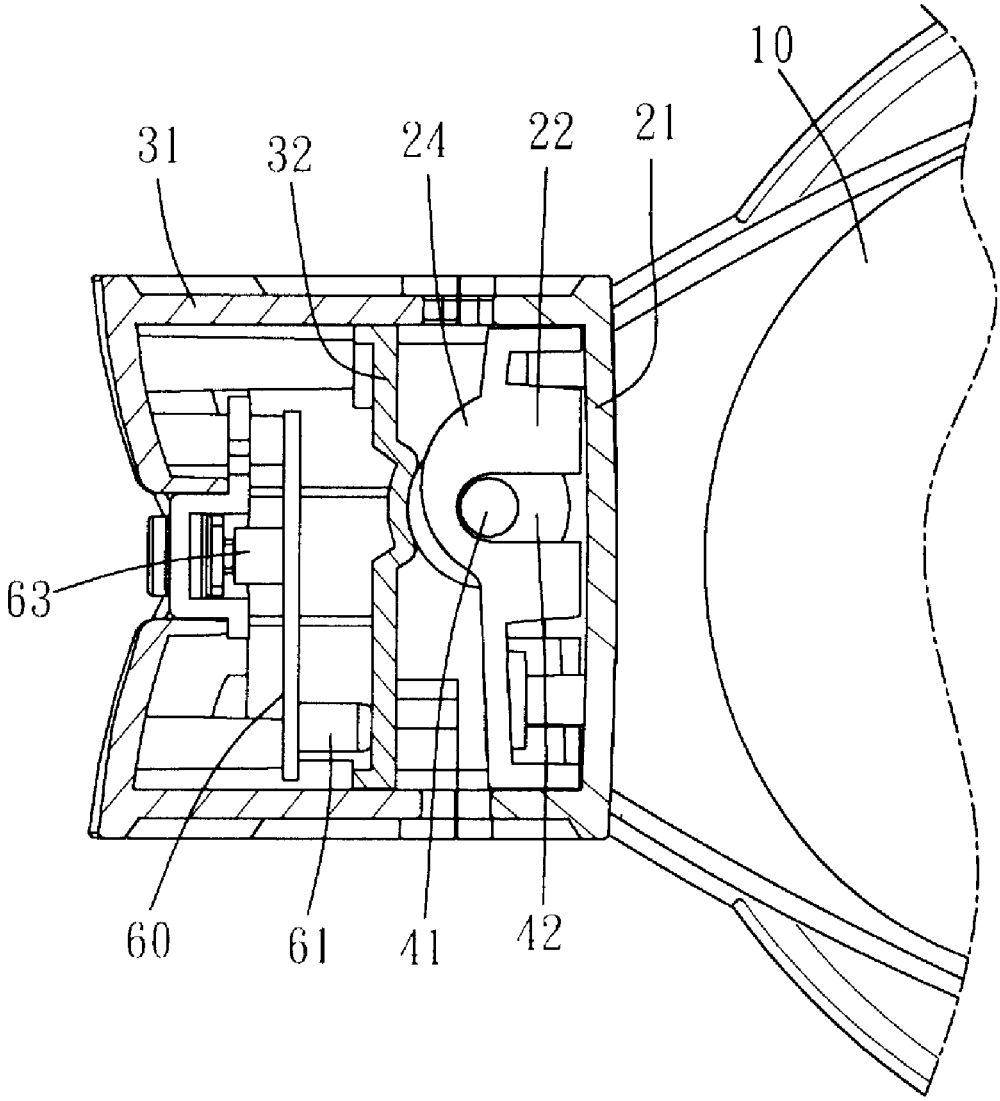
FIG. 5 is an AA profile of FIG. 4.
Figure 6:
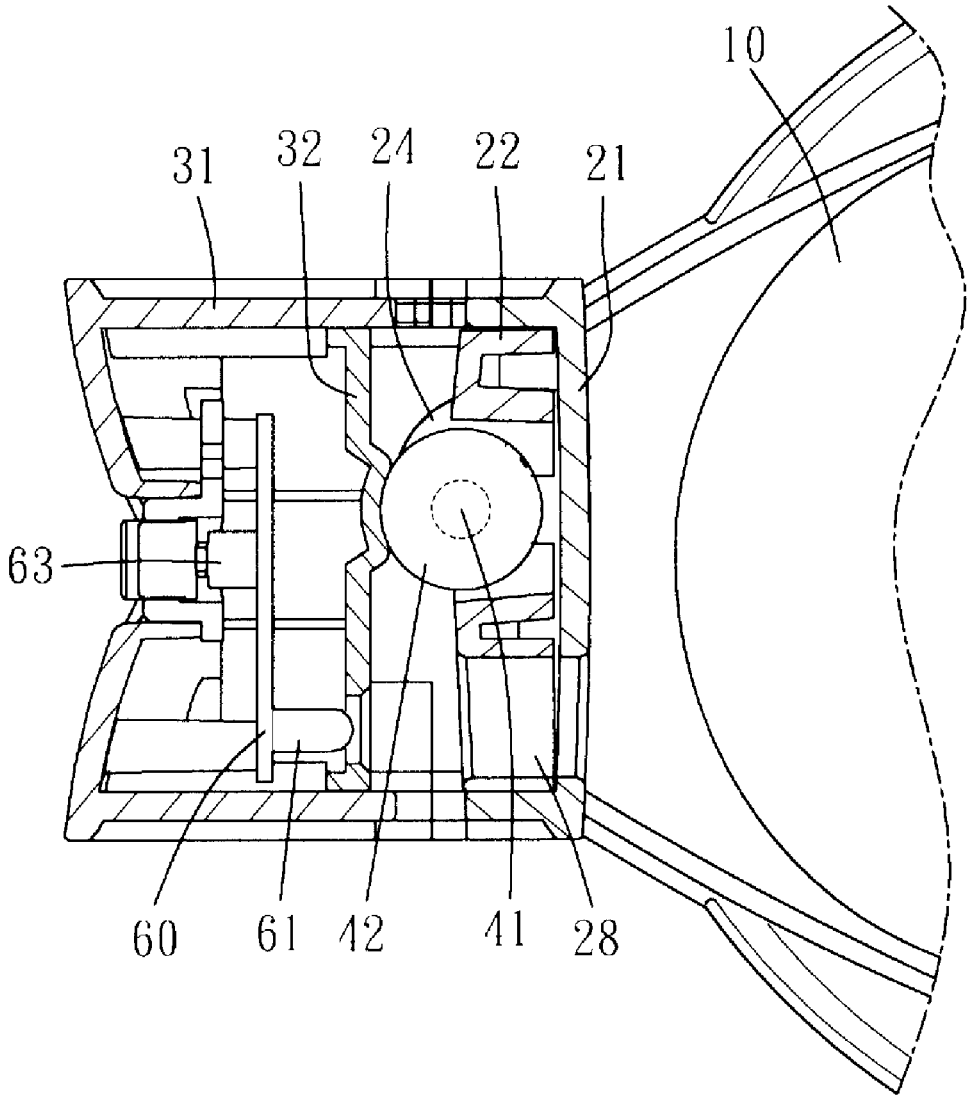
FIG. 6 is a BB profile of FIG. 4.

The roller unit 40 is rotatably disposed in the receiving space and has a axis parallel to the lengthy direction of the shell 20, i.e. the axis of the roller unit 40 is parallel to the opening. The roller unit 30 of the present embodiment includes an axle 41, which works as the axis of the roller unit 40, and five skidproofing sleeves 42 which corresponds to the windows 25. The skidproofing sleeves 42 are made from foaming TPR (thermal plastic rubber), which can reduce the accumulation of electrostatic, or other soft plastic/rubber material. In the present embodiment, the sleeves 42 are spaced sleeved on the axle 41 and are rotatable dependent on the rotation of the axle 41. Each anti-convolving unit 24 locates exactly between two adjacent skidproofing sleeves 42 so that the sleeves 42 protrude from the windows 25. As shown in FIG. 4-6, the sleeves 42 arc in contact with the arc surface of the cover 30 as the cover 30 locates at the first position. As such, the arc surface and the sleeves 42 of the roller unit 40 are adapted to clamp the sheet-like object therebetween as the cover 30 locates at the first position. It is to be noted that the curvature of the arc surface is preferably corresponding to the radius of the sleeves 42 to apply force uniformly on the clamped sheet-like object.

Figure 3:
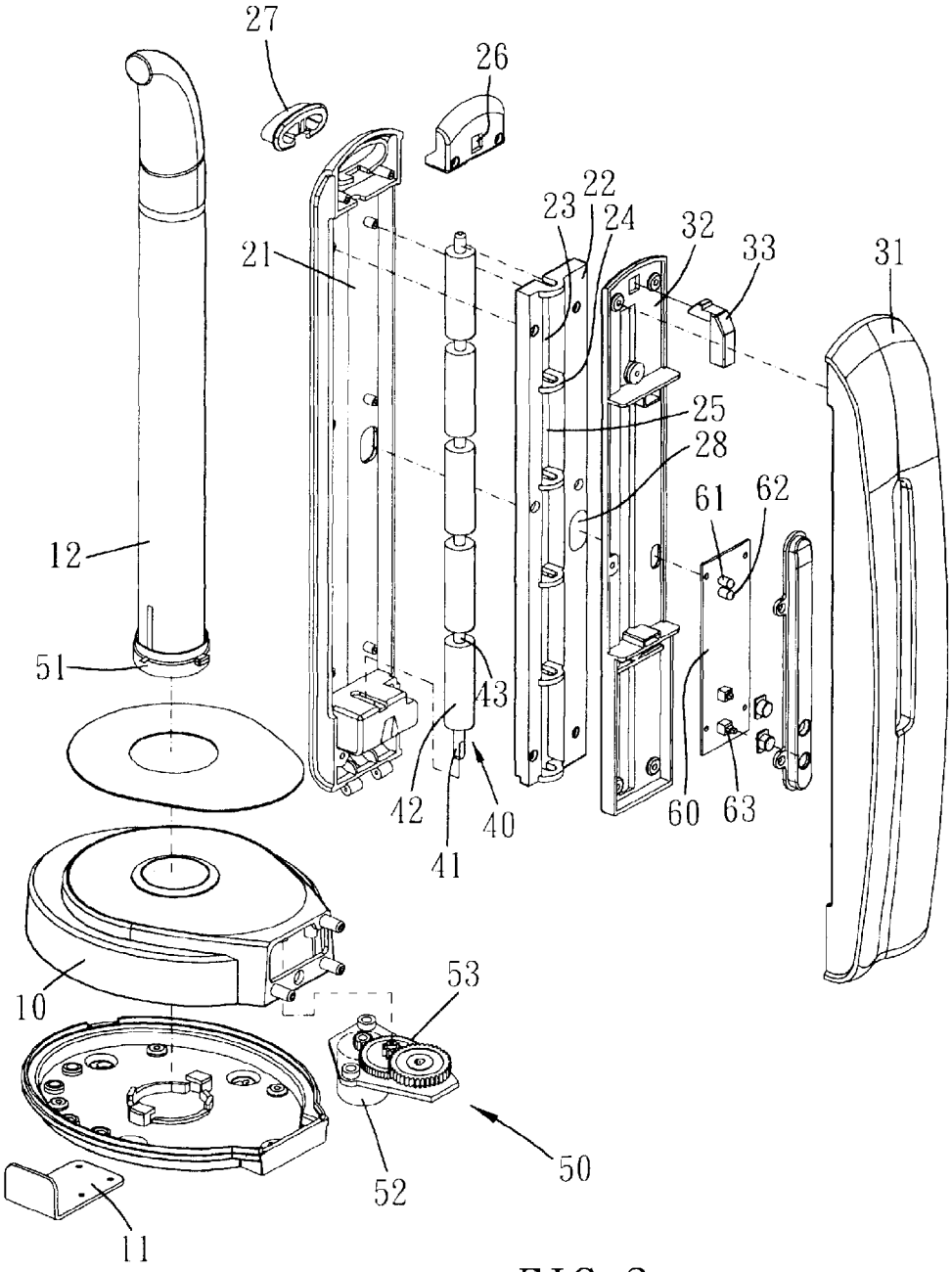
FIG. 3 is an explosive drawing showing a sensing and outputting device in accordance with a preferred embodiment of the present invention.
Figure 7:
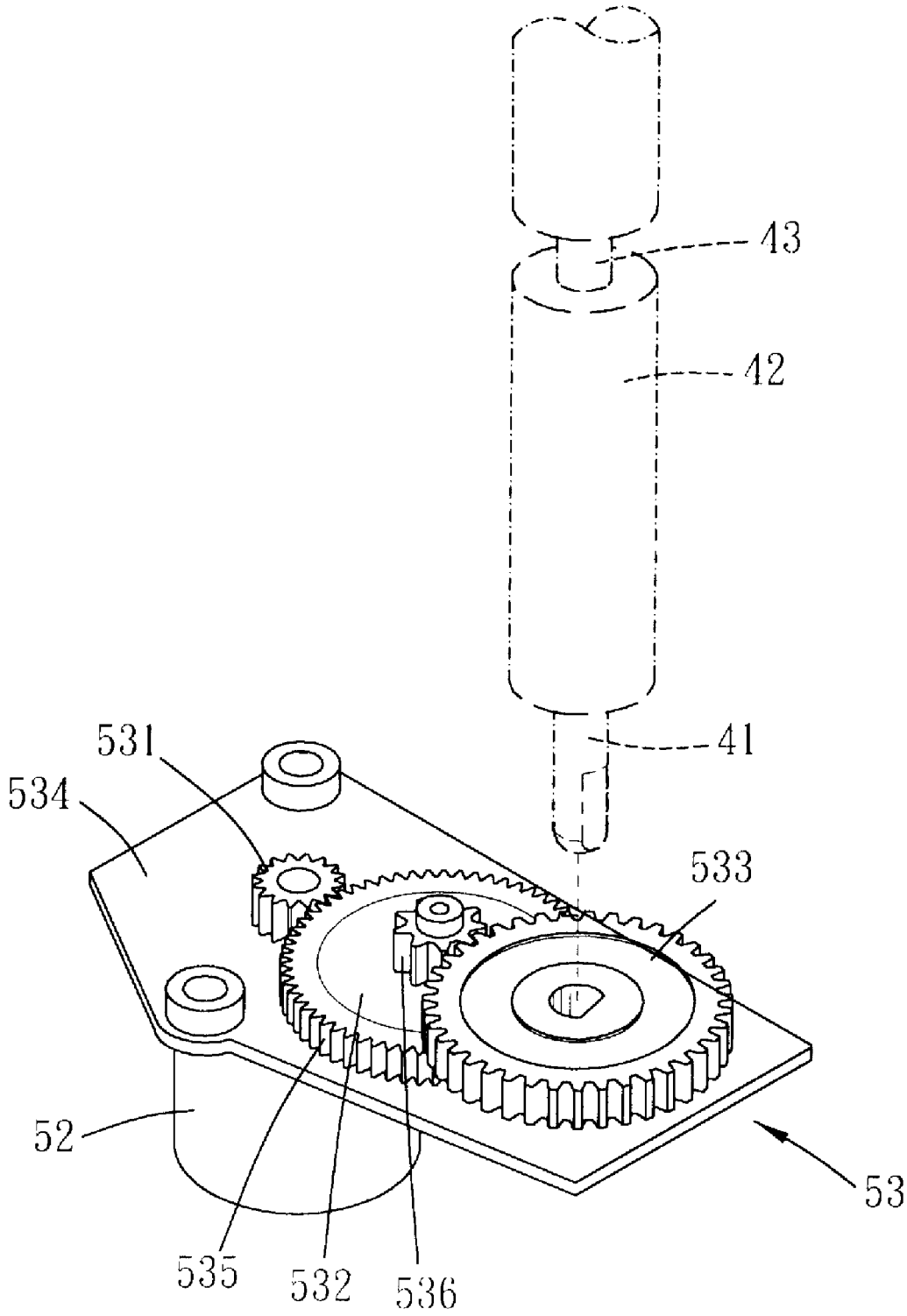
FIG. 7 is a drawing showing a gear set in accordance with a preferred embodiment of the present invention.

The rotating means 50 includes a power source 51 and a motor 52 electrically connected to the power source 51. The power source 51 includes at least one battery installed in a battery room defined in an interior of the longitudinal rod 12. A gear set 53 may be further disposed between the motor 52 and the roller unit 40 as shown in FIGS. 3 and 7. The gear set 53 includes a first gear 531, a second gear 532, a third gear 533 and a plate 534. The first gear 531 is co-axially disposed on the motor 52, the third gear 533 has a 1)-shaped hole to be co-axially disposed on an end of the axle 41 of the roller unit 40, and the second gear 532 connects between the first and third gears 531, 533. More specifically, the second gear 532 has a first teeth wheel 535 and a second teeth wheel 536 which has fewer teeth than the first teeth wheel 535. The first teeth wheel 535 engages with the first gear 531, in which the first teeth wheel 535 has more teeth than the first gear 531. The second teeth wheel 536 engages with the third gear 533, in which the second teeth wheel 536 has fewer teeth than the third gear 533. As such, the axle 41 can rotate at low rotary speed with high torque. The plate 534 is used to position the three gears 531, 532, 533 in the base 10.

Refer to FIG. 1 to 3 again. The control unit 60 may be a circuit board or the like, and the control unit 60 is disposed in the cover 30 and electrically connects the power source 51 and the motor 52, thus controlling the activation of the motor 52. Since the roller unit 40 is rotated as the motor 52 is activated, and since the start end 91 of sheet-like object 90 is outputted as the roller unit 40 rotates, the control unit 60 can determine the length of the outputted sheet-like object 90 by controlling the activation of the motor 52. In the present embodiment, the control unit 60 has three modes for one to choose from. The first and second modes of the control unit 60 simply control the outputted sheet-like object 90 to have different but predetermined length. The third mode of the control unit 60 is a length memorizing mode that records the length of the sheet-like object 90 which is outputted manually, and thus controls the device to output the sheet-like object 90 for a customized length. In addition, the cover 30 further includes a first sensor 61, a second sensor 62 and a man-machine interface 63, such as buttons to be pressed by one who wants to use the device. The first sensor 61 faces the shell to check if the start end 91 of the sheet-like object is clamped between the arc surface and the anti-convolving sleeves 42. The second sensor 62 faces outward. Roth of the sensors 61, 62 are electrically connected to the control unit 60. The second sensor 62 sends a signal to the control unit 60 as it detects something approaching, and the control unit 60, therefore, activates the motor 52 to output the sheet-like object 90. The man-machine interface 63 is disposed on the surface of the cover 30 and electrically connected to the control unit 60 as well. The man-machine interface 63 is operable to switch the modes of the control unit 60.

Figure 8:
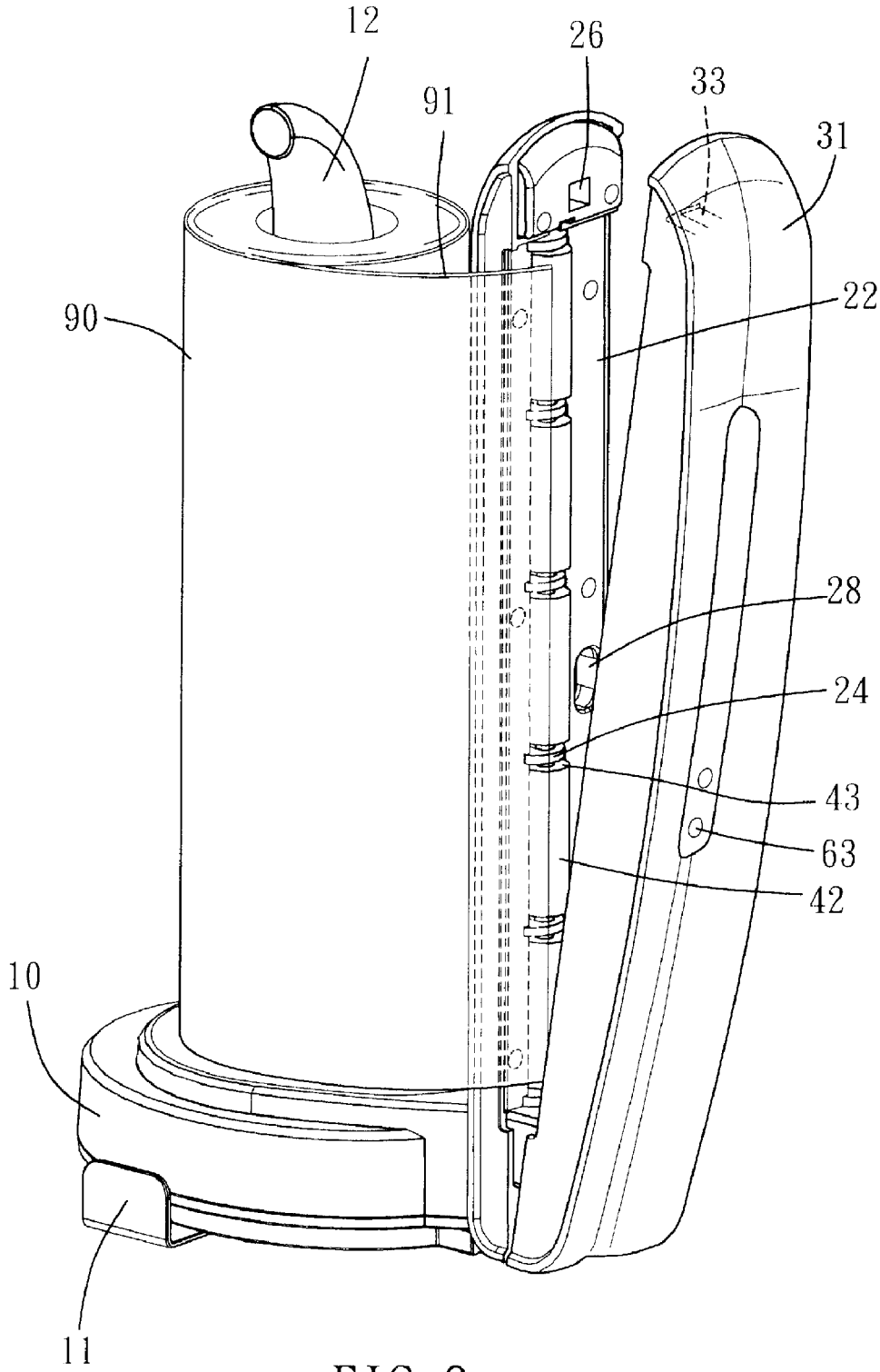
FIG. 8 is a drawing showing a sensing and outputting device as the cover locates at the second position in accordance with a preferred embodiment of the present invention

As shown in FIG. 1, the start end 91 of the sheet-like object 90 is clamped between the arc surface and the anti-convolving sleeves 42 as the cover 30 locates at the first position. The engaging protrusion 33 engages with the engaging slot 26 at the same time. The start end 91 can be further outputted when the second sensor 62 senses one approaching, activating the motor 52 to drive the anti-convolving sleeves 42 to rotate. The length of the outputted sheet-like object 90 is predetermined and controlled by the control unit 60. To get a sheet-like object 90 with different length, one can simply switch the mode of the control unit 60 by operating the man-machine interface 63. When the button 27 is pressed to release the engaging protrusion 33 from the engaging slot 26, the cover 30 can sway to the second position simultaneously as shown in FIG. 8. Therefore, the start end 91 can be easily withdrawn or placed between the cover 30 and the shell 20, allowing one to replace the sheet-like object 90 more conveniently than ever.

What is claimed is:

1. An automatic sensing and outputting device, comprising:

a base, having a longitudinal rod extending from an upper side thereof;

a shell, disposed on the base, the shell being parallel to an orientation of the longitudinal rod, the shell defines a receiving space therein, the shell having an opening disposed in a direction parallel to its length, the opening communicating with the receiving space;

a cover, pivoted at one of its ends on the shell, the cover being swayable between a first position and a second position, the cover enveloping the opening as the cover locates at the first positon, the cover having an arc surface facing the opening;

a roller unit, rotatably disposed in the receiving space and having an axis parallel to the lengthy direction of the shell, a part of the roller unit being protrusive from the opening;

a rotating means to rotate the roller unit;

wherein the arc surface and the roller unit are adapted to clamp a sheet-like object therebetween as the cover locates at the first position;

wherein at least an anti-convolving unit is laterally disposed on the shell to divide the opening into several windows;

wherein the roller unit comprising an axle and several skidproofing sleeves, the skidproofing sleeves are spaced sleeved on the axle, the anti-convolving unit locates between two adjacent skidproofing sleeves, the skidproofing sleeves protrude from the windows.

2. The automatic sensing and outputting device of claim 1, wherein the rotating means comprising a power source and a motor electrically connected to the power source.

3. The automatic sensing and outputting device of claim 2, wherein a gear set is disposed between the motor and the roller unit, the gear set comprising a first gear, a second gear and a third gear, the first gear is co-axially disposed on the motor, the third gear is co-axially disposed on the roller unit, and the second gear connects between the first and third gears.

4. The automatic sensing and outputting device of claim 3, further comprising a control unit, the control unit being electrically connected to the power source to control the motor to drive the roller unit.

5. The automatic sensing and outputting device of claim 4, wherein the sheet-like object is outputted as the roller unit rotates, the length of the outputted sheet-like object is determined by the control unit.

6. The automatic sensing and outputting device of claim 5, wherein the cover comprising a first sensor, a second sensor and a man-machine interface, the first sensor faces the shell, the second sensor faces outward, and the sensors are electrically connected to the control unit, the man-machine interface is disposed on the surface of the cover and electrically connected to the control unit,

7. The automatic sensing and outputting device of claim 6, wherein the control unit has several modes switched by the man-machine interface to vary the length of the outputted sheet-like object.

8. The automatic sensing and outputting device of claim 7, wherein the longitudinal rod defines a battery room therein, the power source comprising at least one battery installed in the battery room.

9. The automatic sensing and outputting device of claim 1, wherein an engaging protrusion and an engaging slot being disposed between the shell and the cover, the engaging protrusion engages with the engaging slot as the cover locates at the first position, whereby the cover is held at the first position steadily.

10. The automatic sensing and outputting device of claim 9, wherein a button is disposed near the engaging slot to be pressed to release the engaging protrusion from the engaging slot.

11. The automatic sensing and outputting device of claim 1, further comprising a positioning plate disposed on a bottom side of the base.

12. The automatic sensing and outputting device of the claim 11, wherein the positioning plate has an anti-slip element.

13. An automatic sensing and outputting device, comprising:

a base, having a longitudinal rod extending from an upper side thereof;

a shell, disposed on the base, the shell being parallel to an orientation of the longitudinal rod, the shell defines a receiving space therein, the shell having an opening disposed in a direction parallel to its length, the opening communicating with the receiving space;

a cover, pivoted at one of its ends on the shell, the cover being swayable between a first position and a second position, the cover enveloping the opening as the cover locates at the first positon, the cover having an arc surface facing the opening;

a roller unit, rotatably disposed in the receiving space and having an axis parallel to the lengthy direction of the shell, a part of the roller unit being protrusive from the opening;

a rotating means to rotate the roller unit;

wherein the arc surface and the roller unit are adapted to clamp a sheet-like object therebetween as the cover locates at the first position;

wherein a distal end of the longitudinal rod is tapered and laterally bent.

* * * * *